United States Patent [19]

Michel

[11] Patent Number: 4,630,545

[45] Date of Patent: Dec. 23, 1986

[54] CHAIR LIFT FITTED WITH A PASSENGER PROTECTIVE DEVICE

[76] Inventor: Max Michel, 7, rue de la Chapelle-St. Sauveur Aincourt, F 95510 Vetheuil, France

[21] Appl. No.: 783,099

[22] Filed: Oct. 2, 1985

[51] Int. Cl.[4] ..... B60N 3/00; B61D 17/12; E04F 10/10; A47C 1/00

[52] U.S. Cl. ..... 105/329.1; 105/1.5; 160/62; 160/132; 297/184

[58] Field of Search ..... 296/78 A, 111, 78 R, 296/105; 105/329 R, 329 S, 329 SC, 2 R; 104/173 ST; 160/62, 132; 297/184

[56] References Cited

U.S. PATENT DOCUMENTS

| | | | |
|---|---|---|---|
| 1,289,965 | 12/1918 | Tichenor | 296/78 A X |
| 3,008,761 | 11/1961 | McIlvaine | 105/329 SC X |
| 3,047,059 | 7/1962 | Trinchero | 160/132 |

FOREIGN PATENT DOCUMENTS

| | | | |
|---|---|---|---|
| 0959446 | 12/1974 | Canada | 105/329 SC |
| 2914001 | 10/1979 | Fed. Rep. of Germany | 104/173 ST |
| 1325828 | 3/1963 | France . | |
| 2422536 | 11/1979 | France . | |
| 2432961 | 3/1980 | France . | |
| 2440298 | 5/1980 | France . | |
| 2489220 | 3/1982 | France . | |
| 0002766 | of 1862 | United Kingdom | 296/105 |

*Primary Examiner*—Robert B. Reeves
*Assistant Examiner*—Scott H. Werny
*Attorney, Agent, or Firm*—Parkhurst & Oliff

[57] ABSTRACT

A device which can be fitted on the chair of a chairlift cable transport system used in tourist resorts and which provides passengers with a protection against cold and adverse weather conditions. Properly shaped plate elements are so arranged that in a deployed position they form a continuous protecting shield extending from above the seat to downward and frontward of the seat and that when in an upward folded position they are superposed so that the device has a very reduced area subject to wind action on empty chairs thus permitting the keeping of all chairs permanently on the cable without jeopardizing the whole line during adverse weather conditions. Springs bias the safe-guard rail towards the folded position. The device adds little weight, is easy to operate by the passengers and does not affect the usual embarcation or disembarcation procedures.

6 Claims, 4 Drawing Figures

CHAIR LIFT FITTED WITH A PASSENGER PROTECTIVE DEVICE

BACKGROUND OF THE INVENTION

The present invention relates to the cable transportation system known as the chair-lift and results in a new concept thanks to a device protecting passengers from adverse weather conditions often prevailing in mountain areas.

Amongst the various types of cable lifts used in winter sport resorts the chair-lift is most interesting as it brings an excellent capacity to investment ratio together with a low cost and reliable operation. However it provides no protection against cold and other adverse weather conditions which often cause very unpleasant rides sometimes lasting more than 15 minutes.

To date none of the proposed solutions has proved acceptable to the trade for practical reasons such as protection restricted to legs only, handling or material problems, line endangered by wind action on the protecting body of the empty chairs or otherwise (U.S. Pat. Nos. 4,275,921, and 4,303,016). Gondola lifts offer a good protection but at a very high cost due to the important body required for sitting up to ten passengers and the large sized lower and upper stations needed to store all gondolas when operation is shut out so that the action of the wind on these light and voluminous structures could not endanger the line.

The recently developed detachable chair lift now offers the same high output but without the costly and cumbersome stations, as empty chairs offering a reduced area to wind action can be left permanently on the line ; however these lifts operate at a speed of up to 5 meters per second which increases the inconvenience of the open chair; obviously an adequate protecting device would then eliminate the only significant, but high priced, advantage offered by the gondola lift over the detachable chair lift.

SUMMARY OF THE INVENTION

One object of the present invention is to provide a device protecting the passengers on a chair-lift against the various adverse weather conditions, which shall be easy to maneuver by the passengers themselves after embarcation and before disembarcation, and which is reliable and sturdy.

Another object of the present invention is to provide satisfactory protection for the most exposed parts of the passenger body and still offer only a very reduced wind area when the chair is empty. Another object of the present invention is to provide such a protection device at a cost and an additional dead weight to make it acceptable for a purely subjective additional value brought to the chair-lift transport system.

The principle of the present invention is to achieve a protective surface extending from above the head of the passengers, down, frontward to just above the ski boots and laterally to about the sitting level by a succession of elements made of thin plates properly shaped to achieve the required surface, so arranged that each one can slide above or under the preceding one with the result that they can become exactly superposed in a more or less vertical position above the chair; when same is unoccupied any wind action being thence exercised on that part of the area of a single element which is exposed to a lateral or vertical wind or on only the total thickness of the superposed elements in case of wind blowing along the axis of the line. Movement from the superposed position to the extended position of the elements and vice versa is caused by the down or upward motion of the conventional safe-guard rail and ski-support device usually fitted on these chair-lifts or by direct action on one of the plates when local regulations allow operation of the lift without such a device, the protecting elements effecting a rotation around a horizontal axis properly located at the back of the chair.

Another basic principle of the invention is that although the system can be easily handled, even by only one passenger, on a multiple seater chair it cannot be unfolded by the wind acting on empty chairs, thus eliminating the risk of wind causing unacceptable force on the cable or the up-lifting of a section of the line to the extent that it will get out from the guiding pulleys on one or more supporting towers.

Another basic principle of the invention is to keep the weight of the device very low so that the carrying capacity is not significantly reduced. Another basic principle of the invention is that the protecting device fits exactly within the transverse suspension arch to which the chair is being attached and no part of it may cause the embarcation or disembarcation by the passengers to become more difficult or hazardous than with a conventional unprotected chair.

The thin plates are made of any material such as plastics of all sorts, polycarbonates and the like, lightweight metal, possibly in combination, apt to be cut to size then properly preformed by cold or thermo-pressing or by any other industrial process and also to be assembled by any usual means, offering the rigidity and all other qualities required to resist severe service and weather conditions without deformation and/or alteration.

The plates could also be obtained in their final form and size through the usual moulding processes such as extrusion, injection or otherwise by processing the constituent materials.

Other objects and advantages of the present invention will become apparent upon reading the following description, from the description of the preferred embodiment and from the accompanying drawings.

DETAILED DESCRIPTION OF THE PREFERRED EMBODIMENT

The preferred embodiment of the invention will now be described. However, it should be understood that this embodiment is solely for illustration purposes and is not intended to limit the scope of the invention to the embodiment represented.

Figure 2:
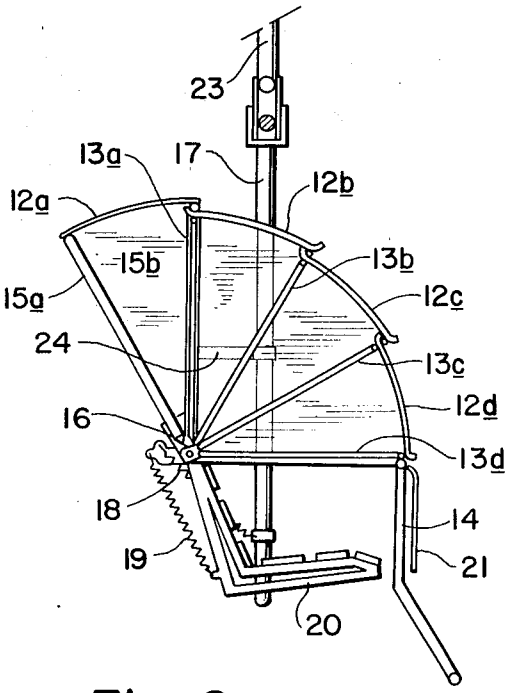
FIG. 2 is a cross section of a deployed device

The lower end 23 of a suspension arm whose upper end is attached to the cable supports a chair 20 by means of a U-shaped tube member or arch 17, transversely articulated on end 23. The typical standard chair 20 comprises a safe-guard rail 14 and ski resting traverse shown in lowered position in FIG. 2. The chair 20 is fitted with protecting plates 12 properly shaped to ensure overhead, frontal and lateral protection in the deployed position.

Figure 1:
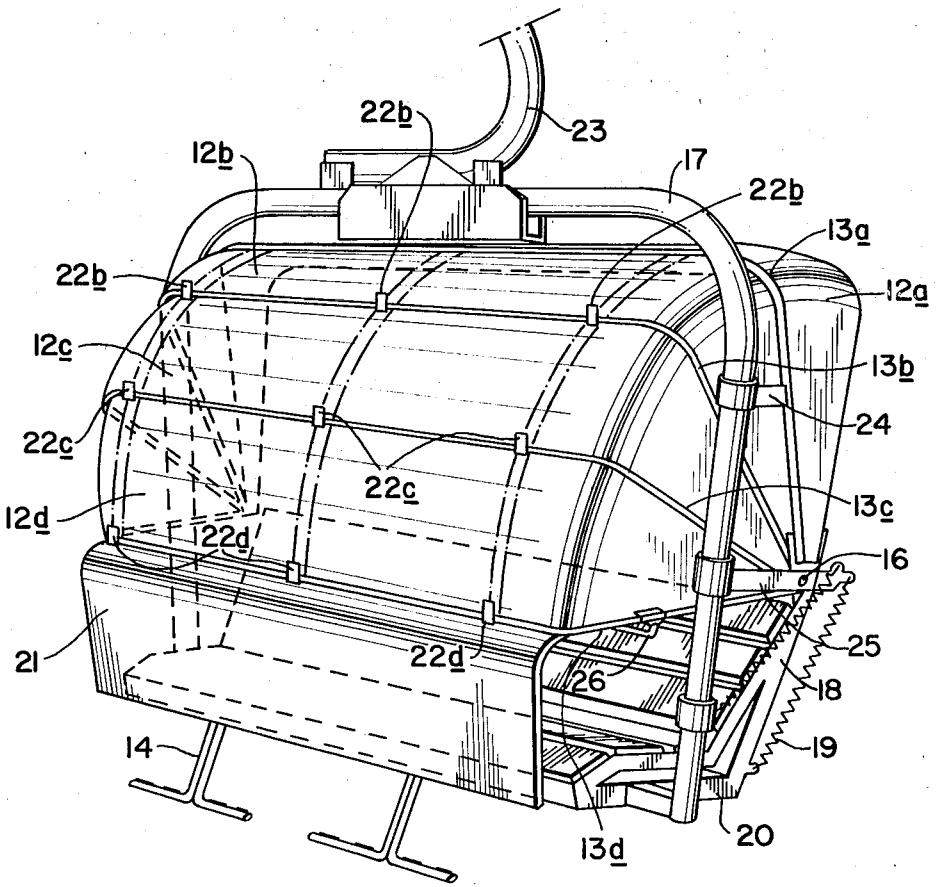
FIG. 1 is a perspective view of a deployed protecting device on a four seater chair.
Figure 3:
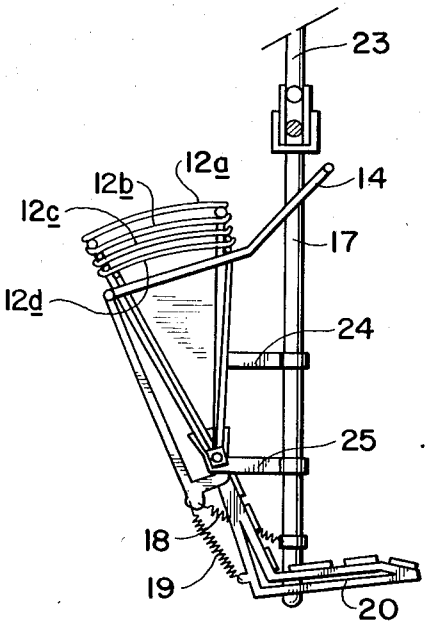
FIG. 3 is the cross section of a folded device in the upward, folded position when a chair is empty
Figure 4:
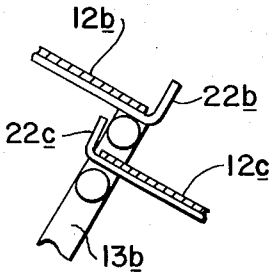
FIG. 4 is an enlarged view showing details of the arrangement of two adjacent plate elements.

Plate 12*a* is attached to two steel tubes 15*a* and 15*b* of the same shape which are tied up to the V shaped tube 17 through steel pieces 24 and 25 in such a fixed position that both branch ends of tubes 15*a* and 15*b* are in line with a horizontal rotation axis 16 of the movable plates 12*b*, 12*c*, 12*d*; these plates 12*b* to 12*d* are tied up to light alloy tube arches 13*a* to 13*d* of the same shape which all can rotate around the horizontal axis 16 under action of the safe-guard rail 14 by the passenger(s) thanks to the L shaped abutments 22 provided at the fore and back edges as shown on the enlarged figure 4 detailing the working arrangement between plates 12*b* and 12*c*. The plate 12*d* and tube 13*d* are properly connected to the safe-guard rail 14 by means of a lock 26. The plates 12 and tubes 13 are so designed that each plate can fit very closely under the preceding one, as evidenced on FIG. 3 showing the safe-guard rail 14 and protecting device in an upward folded position corresponding to an unoccupied chair. After having boarded the seat, passengers reach for the safe-guard rail 14, a familiar procedure, and lower it to its horizontal position thus causing the simultaneous deployment of the protecting device without much additional effort, the abutment 22 of each set of plate-tubes for arches 13 moving the preceding one by its own weight on its downward trajectory after the movement has been initiated. Upon reaching the disembarcation point, in order to leave the chair, passengers have to raise the safe-guard rail 14 and it is this familiar procedure which is also used for folding up the protecting device of the present invention. Springs 18 and 19 provide assistance to reduce the required effort to raise the whole system and secure it in the folded position illustrated in FIG. 3 even under very windy conditions. A leg protecting apron 21 is directly fitted on the safe-guard rail 14 in such a position that when the rail is up the apron 21 will fit exactly underneath plate 12*d* or above plate 12*a* whatever fits better with the chair design of each manufacturer.

By unlocking tube 13*d* from safe-guard rail 14 by release of the lock 26, passengers can also ride without the protecting device if they wish to do so. From the foregoing it will be observed that numerous variations and modifications may be effected without departing from the spirit and the scope of the novel concept of the invention. It is to be understood that no limitation with respect to the specific embodiment or methods illustrated herein is intended or should be inferred whatever alternative materials shaping, assembling and or motion processes are proposed. It is, of course, intended to cover, by the appended claims, all such modifications as fall within the scope of the claims.

What I claim is:

1. A chair for an aerial cableway chair-lift comprising:

a seat with an open front side and a back, a hanger for suspending the chair to the aerial cable, a safe-guard rail pivoted to said seat and pivotal between an upward rest position and a forward position in which said safe-guard rail is positioned in front of the open front side of the seat, a plurality of rigid plates partially encompassing said seat and each including a transverse portion connected to pair of lateral side portions, each of which is pivotally connected at its end to said seat for pivoting the plate about a transverse axis between an upward folded position, in which the transverse portions of the plates are disposed substantially horizontally, and an operative deployed position, said plates being shaped and so arranged that each one can slide above or under the next preceding one to become superposed in said upward folded position, the transverse portions being in their upward substantially horizontal position away from the front of the seat and towards the aerial cable and movable to their deployed position in which the plates are disposed side by side with their edges overlapping to form a continuous shield extending from above the seat to downward and frontward of the seat, spring means resiliently biasing said safe-guard rail with respect to said seat to bias said rail and said plurality of plates towards said folded position.

2. A chair according to claim 1, having a transverse axis whereon said safe-guard rail and said plates are pivotally mounted, said axis being disposed at the back of the seat.

3. A chair according to claim 1 wherein each of said plates comprises at least one arch of a shape conforming to an associated plate, rigidly secured to one edge of the plate and pivotally mounted at its ends, and an abutment device secured to an edge opposite to said one edge to limit the sliding of the plate with respect to the arch of the preceding plate when the plates are moved towards the deployed position.

4. A chair according to claim 1, wherein a first plate of said plurality of plates is rigidly secured with respect to said hanger .

5. A chair according to claim 4 wherein said plurality of plates includes a last plate disposed most remotely away from the first plate in the deployed position, and a lock for securing said last plate to said safe-guard rail.

6. A chair according to claim 1 in which said transverse portions, when in their folded position, form a stack in which substantially only the top, the sides, and the front and rear edges thereof are exposed to wind loading.

* * * * *